US011033093B2

(12) United States Patent
Bingener

(10) Patent No.: US 11,033,093 B2
(45) Date of Patent: Jun. 15, 2021

(54) SPACE-SAVING HAMMOCK STAND

(71) Applicant: Klug Inventions LLC, White Salmon, WA (US)

(72) Inventor: Eric Bingener, White Salmon, WA (US)

(73) Assignee: Klug Inventions LLC, White Salmon, WA (US)

( * ) Notice: Subject to any disclaimer, the term of this patent is extended or adjusted under 35 U.S.C. 154(b) by 0 days.

(21) Appl. No.: 16/794,547

(22) Filed: Feb. 19, 2020

(65) Prior Publication Data

US 2020/0260845 A1 Aug. 20, 2020

Related U.S. Application Data

(60) Provisional application No. 62/807,663, filed on Feb. 19, 2019.

(51) Int. Cl.
*A45F 3/24* (2006.01)

(52) U.S. Cl.
CPC ..... *A45F 3/24* (2013.01)

(58) Field of Classification Search
CPC ..... A45F 3/22; A45F 3/24; A45F 3/26; A47C 17/84; A61G 7/1051; A61G 7/1055; A61G 7/1015
See application file for complete search history.

(56) References Cited

U.S. PATENT DOCUMENTS 1,330,688 A 2/1920 Demlinger
4,229,845 A 10/1980 De Cuadros
5,003,652 A * 4/1991 Bayless ..... A45F 3/24 5/122
5,046,203 A 9/1991 Turk
5,113,537 A 5/1992 Turk
6,467,110 B1 * 10/2002 Ketcher ..... A45F 3/22 5/120
6,851,138 B1 * 2/2005 Wilson ..... A45F 3/24 5/120

(Continued)

FOREIGN PATENT DOCUMENTS

DE 102005062593 B4 10/2007
KR 200472595 Y1 5/2014

(Continued)

OTHER PUBLICATIONS

Jun. 9, 2020, International Search Report and Written Opinion of the International Searching Authority from the Korean Intellectual Property Office, in PCT/US2020/018747, which is an international application corresponding to this U.S. application.

*Primary Examiner* — Nicholas F Polito
*Assistant Examiner* — George Sun
(74) *Attorney, Agent, or Firm* — Kolitch Romano LLP

(57) ABSTRACT

A space-saving hammock stand includes features configured to improve hammock usability in situations where use of a conventional hammock stand may be difficult. In some examples, space-saving hammock stands include features intended to reduce an overall footprint of the hammock stand (e.g., by hanging the hammock diagonally and/or in a corner of a room). In some examples, space-saving hammock stands are collapsible. In some examples, space-saving hammock stands are configured to be coupled to or suspended from a vehicle.

20 Claims, 13 Drawing Sheets

(56) References Cited

U.S. PATENT DOCUMENTS

| | | | | |
|---|---|---|---|---|
| 6,865,757 | B2 | 3/2005 | Hennessy | |
| 8,296,880 | B1 | 10/2012 | Hennessy | |
| 9,179,759 | B1 * | 11/2015 | Turner | B60P 3/36 |
| 10,016,047 | B2 | 7/2018 | Waddy | |
| 10,035,472 | B1 * | 7/2018 | Turner | A45F 3/22 |
| 2007/0079442 | A1 * | 4/2007 | Stoll | A45F 3/24 5/120 |
| 2007/0113337 | A1 * | 5/2007 | Hug | A45F 3/22 5/120 |
| 2010/0287700 | A1 * | 11/2010 | Reeb | A45F 3/22 5/127 |
| 2013/0117931 | A1 | 5/2013 | Lemmens | |
| 2016/0058197 | A1 | 3/2016 | Jungling | |
| 2018/0206645 | A1 * | 7/2018 | Mason | A47C 9/10 |
| 2018/0228272 | A1 * | 8/2018 | Locher | E04H 15/04 |
| 2019/0048613 | A1 * | 2/2019 | Bierwolf | E04H 15/40 |

FOREIGN PATENT DOCUMENTS

| | | | |
|---|---|---|---|
| KR | 20180063467 | A | 6/2018 |
| WO | 01074194 | A1 | 10/2001 |
| WO | 2004017791 | A1 | 3/2004 |
| WO | 2005023050 | A1 | 3/2005 |

* cited by examiner

SPACE-SAVING HAMMOCK STAND

CROSS-REFERENCES

This application claims the benefit under 35 U.S.C. § 119(e) of the priority of U.S. Provisional Patent Application Ser. No. 62/807,663, filed Feb. 19, 2019, the entirety of which is hereby incorporated by reference for all purposes.

FIELD

This disclosure relates to systems and methods for holding hammocks off the ground. More specifically, the disclosed embodiments relate to space-saving hammock stands.

INTRODUCTION

Generally speaking, it is difficult to hang a hammock indoors due to the forces involved and the limitations of available hammock designs. Attaching a hammock to one or more walls of a normal house is problematic due to the heavy loads imparted by a hammock when in use.

Typical freestanding hammock stands use either one large support member down the centerline (i.e., below the "spine" of the hammock) or a symmetrically-arranged pair of supports, one on either side of the centerline. They are also not typically collapsible. These hammock stands may be impractical for indoor use, as they take up a comparatively large amount of space in relation to seating

SUMMARY

The present disclosure provides systems, apparatuses, and methods relating to space saving hammock stands.

In some embodiments of the present disclosure, a hammock stand may include: a support frame having a horizontal base with horizontal first and second legs extending in a same direction from opposite ends of the base; a first hammock support post extending upward from the first leg of the support frame; a second hammock support post extending upward from the second leg of the support frame; and a hammock extending from the first hammock support post to the second hammock support post; wherein the first and second hammock support posts are respectively positioned along the first and second legs such that a centerline of the hammock forms an acute angle with respect to the base of the frame when viewed from above.

In some embodiments of the present disclosure, a hammock stand may include: a support frame including a main horizontal frame member, and a first leg and a second leg extending horizontally from a same side of the main horizontal frame member, such that the support frame is configured to conform to a corner of a room with the main horizontal frame member running along a first wall and the first leg running along a second wall; a first hammock support post extending upward from the first leg; a second hammock support post extending upward from the second leg; wherein the first hammock support post is spaced a first distance from the main horizontal frame member along the first leg, the second hammock support post is spaced a second distance from the main horizontal frame member along the second leg, and the first distance is greater than the second distance.

In some embodiments of the present disclosure, an asymmetrical freestanding support structure configured to hold a hammock may include: a floor support platform including a main horizontal floor support member and a first horizontal floor support member coupled together at respective first ends to form a 90-degree angle, such that the support structure is configured to conform to a corner of a room; and a second horizontal floor support member extending at a 90-degree angle from a second end of the main horizontal floor support member; wherein the hammock is supported across the corner at an angle by upright supports, one of which extends upward from the first horizontal floor support member and the other of which extends upward from the second horizontal floor support member.

Features, functions, and advantages may be achieved independently in various embodiments of the present disclosure, or may be combined in yet other embodiments, further details of which can be seen with reference to the following description and drawings.

DETAILED DESCRIPTION

Figure 1:
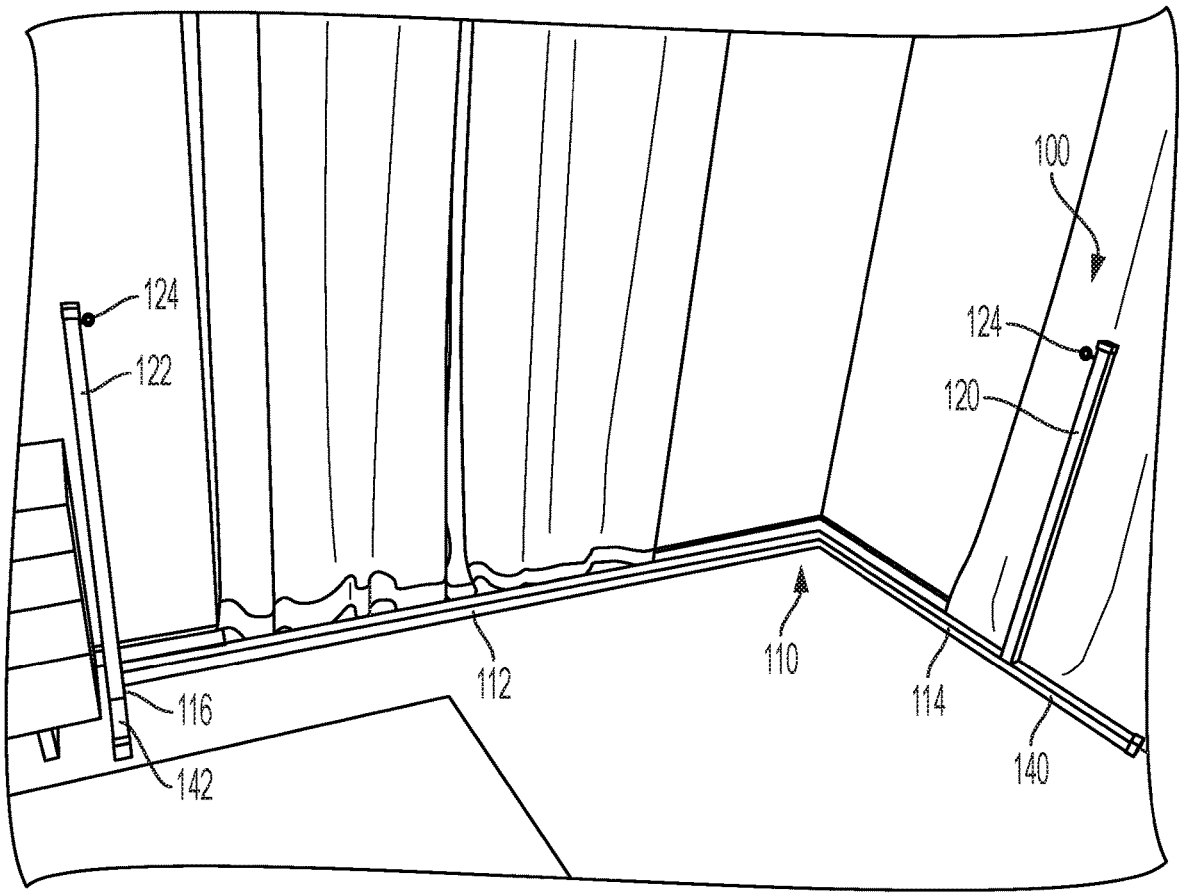
FIG. 1 is an isometric view of a first illustrative hammock stand in a corner of a room.

Various aspects and examples of space-saving hammock stands, as well as related methods, are described below and illustrated in the associated drawings. Unless otherwise specified, a space-saving hammock stand in accordance with the present teachings, and/or its various components, may contain at least one of the structures, components, functionalities, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed embodiments. The following description of various examples is merely illustrative in nature and is in no way intended to limit the disclosure, its application, or uses. Additionally, the advantages provided by the examples and embodiments described below are illustrative in nature and not all examples and embodiments provide the same advantages or the same degree of advantages.

This Detailed Description includes the following sections, which follow immediately below: (1) Definitions; (2) Overview; (3) Examples, Components, and Alternatives; (4) Advantages, Features, and Benefits; and (5) Conclusion. The Examples, Components, and Alternatives section is further divided into subsections A through D, each of which is labeled accordingly.

Definitions

The following definitions apply herein, unless otherwise indicated.

"Comprising," "including," and "having" (and conjugations thereof) are used interchangeably to mean including but not necessarily limited to, and are open-ended terms not intended to exclude additional, unrecited elements or method steps.

Terms such as "first", "second", and "third" are used to distinguish or identify various members of a group, or the like, and are not intended to show serial or numerical limitation.

"AKA" means "also known as," and may be used to indicate an alternative or corresponding term for a given element or elements.

"Elongate" or "elongated" refers to an object or aperture that has a length greater than its own width, although the width need not be uniform. For example, an elongate slot may be elliptical or stadium-shaped, and an elongate candlestick may have a height greater than its tapering diameter. As a negative example, a circular aperture would not be considered an elongate aperture.

"Coupled" means connected, either permanently or releasably, whether directly or indirectly through intervening components.

Directional terms such as "up," "down," "vertical," "horizontal," and the like should be understood in the context of the particular object in question. For example, an object may be oriented around defined X, Y, and Z axes. In those examples, the X-Y plane will define horizontal, with up being defined as the positive Z direction and down being defined as the negative Z direction.

In this disclosure, one or more publications, patents, and/or patent applications may be incorporated by reference. However, such material is only incorporated to the extent that no conflict exists between the incorporated material and the statements and drawings set forth herein. In the event of any such conflict, including any conflict in terminology, the present disclosure is controlling.

Overview

In general, space-saving hammock stands described below are designed to include features which improve their suitability for conditions in which conventional hammock use is difficult. Hammock stands in accordance with the present teachings may be designed and/or configured to be uniquely storable, space-efficient, and/or portable when compared with present hammock stands. In some examples, space-saving hammock stands are designed to maximize use of available space. In some examples, space-saving hammock stands are designed to be collapsible and/or portable, allowing for easy storage when the hammock stand is not in use. In some examples, space-saving hammock stands are designed to be coupled to a rear end of a vehicle, for ease of use when camping or traveling.

In general, a corner hammock stand includes an asymmetrical freestanding support structure configured to hold a hammock, and the support structure is configured to conform to the corner of a room. The support structure may further be configured to hold the hammock across the corner at an angle.

In general, a collapsible A-frame hammock stand includes an A-frame support structure having a first pair of legs and a second pair of legs, the first pair of legs being coupled to the second pair of legs, such that the structure is configured to hold a hammock. In this context, the pairs of legs are defined by the corresponding lateral side of the hammock stand, rather than at each end. Accordingly, the legs are configured such that one pair is on one lateral side of the hammock when in use, and the other pair is on an opposite side of the hammock. The support structure is collapsible from an operational configuration into a storage configuration, by pivoting one pair of legs against the other pair. The support structure has only one horizontal support at the floor level, running between one pair of legs.

In general, a vehicle bumper-mounted collapsible hammock stand includes a pair of stub receivers attachable to a vehicle bumper at either end of the bumper. A pair of corresponding hammock support members are insertable into the stub receivers, where the support members are rigid and have a length that places their distal ends at suitable positions for hanging a hammock therefrom. The support structure is collapsible from an operational configuration into a storage configuration, by (a) removing the support members from the receivers and storing the support members, or (b) rotating the receivers at a hinged joint to pivot the support members against the bumper.

Each of these hammock stands is described in greater detail below.

Examples, Components, and Alternatives

The following sections describe selected aspects of illustrative space-saving hammock stands as well as related systems and/or methods. The examples in these sections are intended for illustration and should not be interpreted as limiting the scope of the present disclosure. Each section may include one or more distinct embodiments or examples, and/or contextual or related information, function, and/or structure.

A. Illustrative Corner Hammock Stand

As shown in FIGS. 1-7, this section describes an illustrative corner hammock stand 100. Corner hammock stand 100 is an indoor example of the space-saving hammock stands described above.

Figure 2:
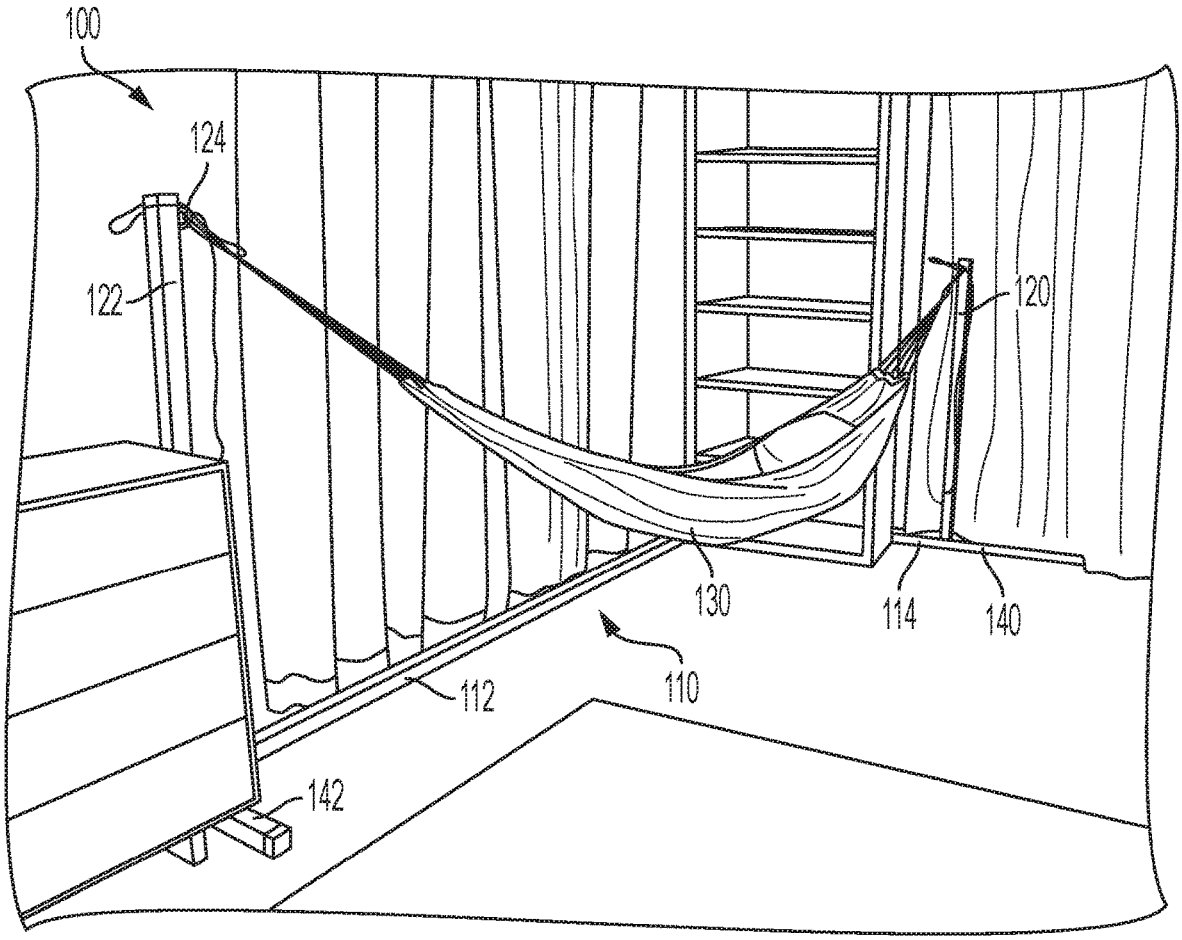
FIG. 2 is an isometric view of the hammock stand of FIG. 1, supporting a hammock.
Figure 3:
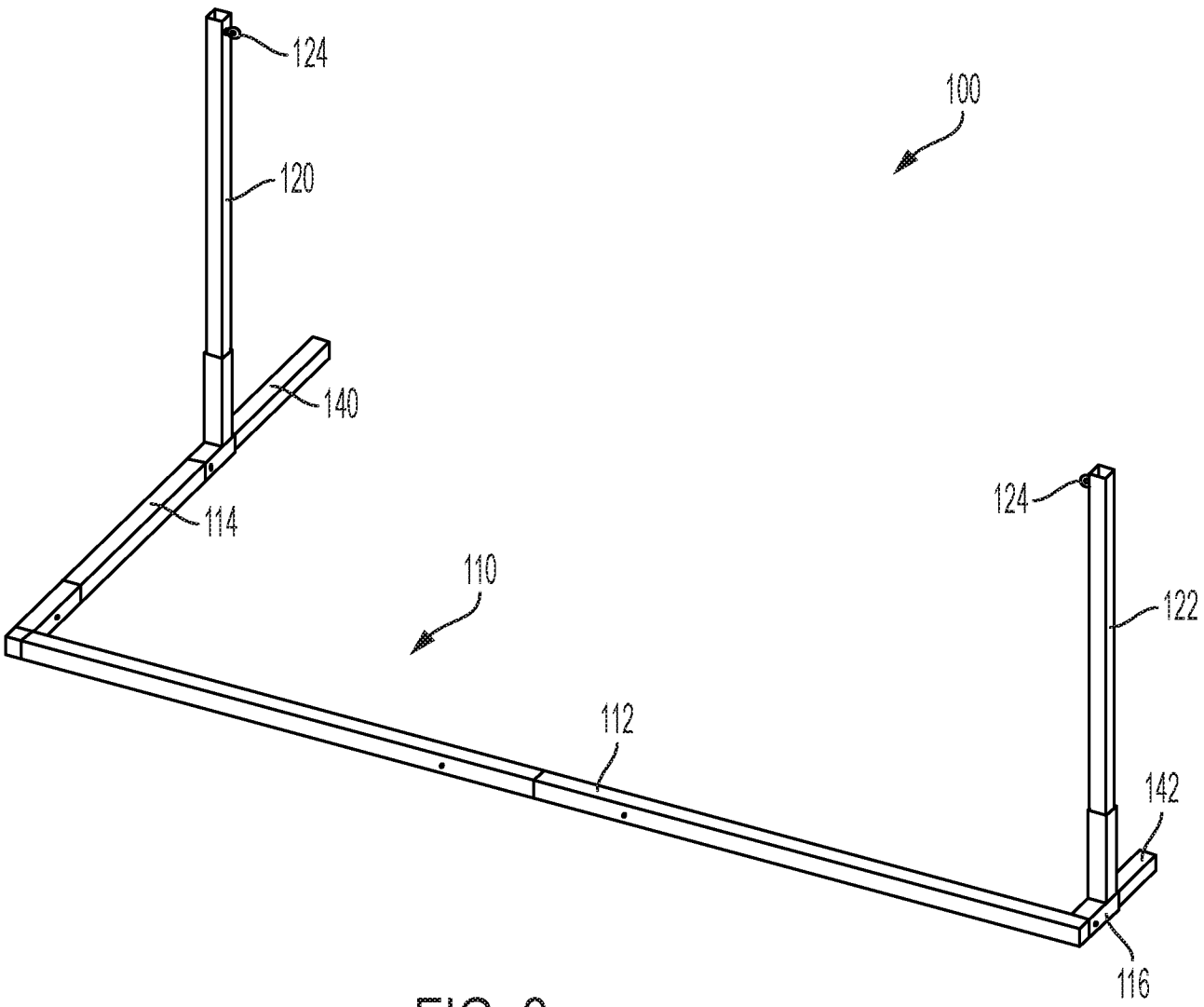
FIG. 3 is a rear isometric view of the hammock stand of FIG. 1.
Figure 4:
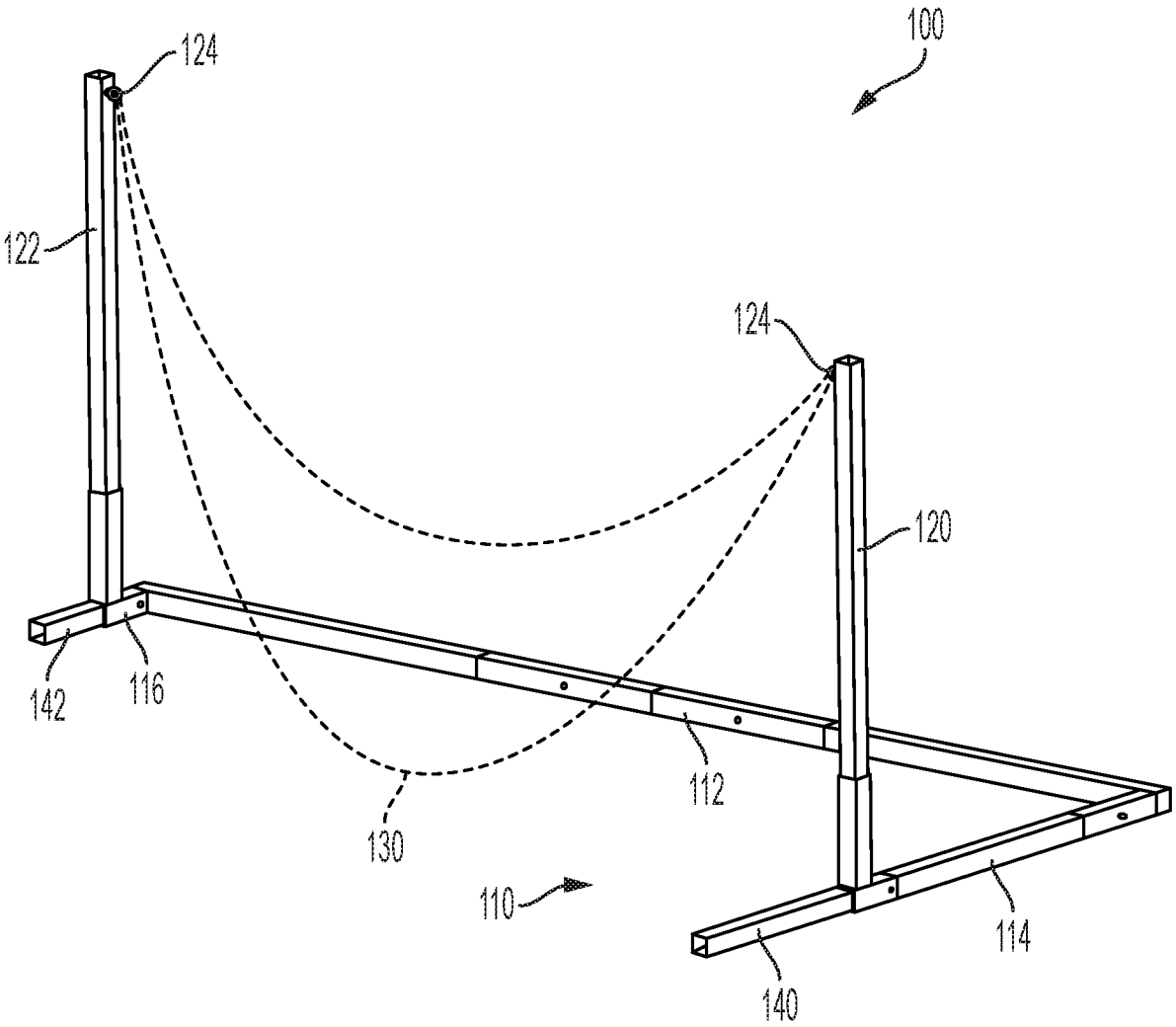
FIG. 4 is a front isometric view of the hammock stand of FIG. 1.

As depicted in FIGS. 1-2, corner hammock stand 100 has an offset support structure or frame that includes a rigid floor support 110 configured to run generally along two walls that meet in a corner of a room, e.g., in a house, apartment, or other building.

Floor support 110 includes a main horizontal frame member 112, a first horizontal leg 114 extending transversely from the main horizontal frame member at one end, and a second horizontal leg 116 extending transversely from the main horizontal frame member at the other end. In general, the main horizontal member is longer than the two legs, and the first horizontal leg is longer than the second horizontal leg. This creates a generally planar, asymmetrical U-shaped horizontal support structure, with one leg of the U being longer than the other. As depicted in FIGS. 1 and 2, main horizontal frame member 112 and first horizontal leg 114 are configured to run along the walls of a room, and to meet in a corner thereof.

A first upright hammock support member 120 extends upward from the first horizontal leg, and a second upright support member 122 extends upward from the second horizontal leg. In this example, the upright support members (AKA hammock support posts) are disposed at distal ends of the first and second horizontal legs, although the legs also have extensions as described below. In some examples, the upright support members are disposed at a point between the proximal and distal ends of each horizontal leg, e.g., where each horizontal leg is one piece, without a separate extension.

A hammock 130 is attachable to upper ends of the first and second upright support members, as shown in FIG. 2. The longer first leg allows one end of the hammock to be disposed farther into the room than the other end of the hammock. In this example, the hammock is oriented at an approximately 17-degree angle across the corner. However, any suitable angle from 15 degrees to 45 degrees may be utilized. For example, the angle may be 30 degrees.

As hammocks typically swing from side to side during use, significant lateral support is needed for any hammock stand. By having the main support structure run along two walls into a corner, space directly under and around the hammock (away from the corner) is freed. This arrangement frees up space by utilizing a support frame disposed on both ends and only one lateral side of the hammock, instead of conventional supports which are normally disposed directly under the hammock or on both sides.

Generally speaking, hammock 130 is supported on one side by horizontal frame member 112 and first horizontal leg 114, which are disposed along walls leading into the corner. On the other side of the hammock, support is provided by two frame extensions: a first frame extension 140 extending from first horizontal leg 114, and a second frame extension 142 extending from second horizontal leg 116. In some examples, one or both pairs of frame extensions and horizontal legs are formed as a single piece, rather than the two-piece construction depicted.

Hanging the hammock at an angle allows for a smaller overall stand footprint than is possible with conventional hammock supports. The reduction in footprint enabled by this configuration makes the hammock stand more suitable for indoor use, or for use in other areas where space is at a premium.

Turning to FIGS. 3-7, further details of hammock stand 100 are now described. As already explained, hammock stand 100 includes a floor support configured to hold a hammock at an angle across a corner of a room. The U-shaped portion of the floor support includes main horizontal frame member 112, first horizontal leg 114, and second horizontal leg 116. Main horizontal frame member 112 is disposed between first horizontal leg 114 and second horizontal leg 116, which are coupled (e.g., fixed) transversely to each end of main horizontal frame member 112 (e.g., at 90-degree angles) to form a generally planar platform structure. As described above, first horizontal leg 114 and second horizontal leg 116 protrude from a same side of main horizontal frame member 112, such that the platform generally forms an asymmetrical "U" shape. Main horizontal frame member 112 and first horizontal leg 114 are generally designed to extend along two walls, which meet at a corner. Second horizontal leg 116 may be disposed substantially parallel to first horizontal leg 114, and may extend a short way into a room in which the hammock stand is located. The horizontal legs and/or associated extensions may be described as peripheral support members.

First extension 140 is coupled to a distal end of first horizontal leg 114, and second extension 142 is coupled to a distal end of second horizontal leg 116. In this example, first extension 140 and second extension 142 extend along a line defined by each respective leg, such that each extension and leg form a single elongate support. This single elongate support may be referred to overall as a support leg. In some examples, the first horizontal leg and the first extension are fixed (e.g., welded, bolted, and/or pinned) together to form a combined first support leg and the second horizontal leg and the second extension are fixed (e.g., welded, bolted, and/or pinned) together to form a combined second support leg.

The floor platform formed by the horizontal frame members defines an X-Y plane. Accordingly, upright support members 120 and 122 are coupled to the floor platform such that they extend upward in a generally Z-axis direction. For example, the floor platform may be horizontal while the upright supports are vertical. However, suitable variations from the strict Z-axis or vertical orientation may be utilized, depending on the particular application. For example, the upright support members may be splayed away from each other slightly.

Hammock support rings 124 or other suitable hammock connectors are coupled to upper ends of first and second upright hammock support members 120 and 122. In some examples, support rings 124 may instead be embodied as hooks, clips, pins, pegs, and/or the like. Any suitable structure configured to provide a fastening mechanism for a hammock may be utilized. Support rings 124 are each configured to hold an end of a hammock, e.g., clipped or tied thereto. In some examples, the first and second upright support members include slots or grooves at upper ends configured to hold ends of a hammock.

Figure 5:
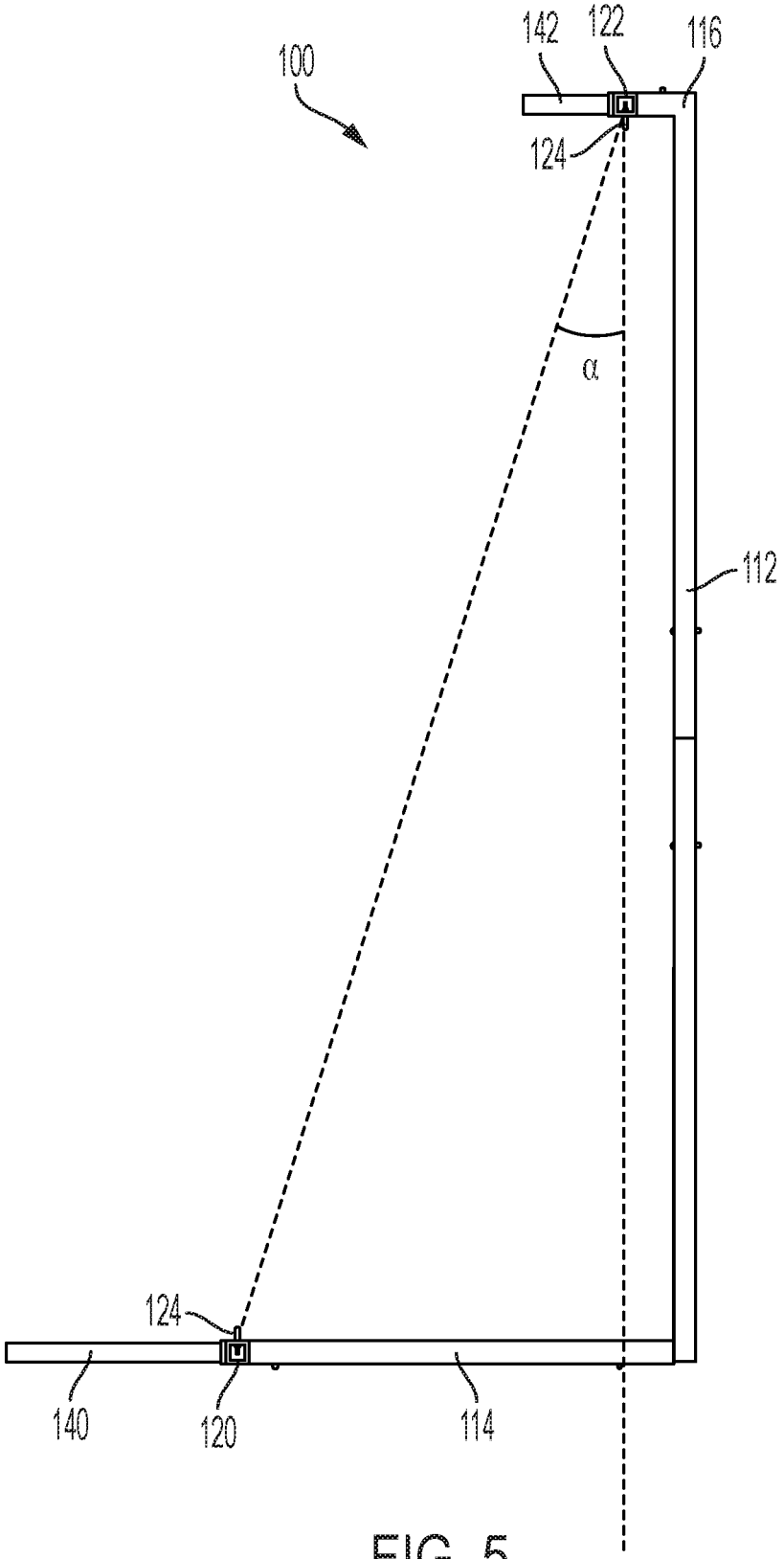
FIG. 5 is a top plan view of the hammock stand of FIG. 1.

FIG. 5 depicts a top plan view showing relative lengths of the various components of support frame 110. The three horizontal frame members have different overall lengths, such that second horizontal leg 116 is shorter than the others, while main horizontal frame member 112 is longer than the others. Accordingly, second horizontal leg 116 may be referred to as the short floor support member, main horizontal frame member 112 may be referred to as the long support member, and first horizontal leg 114 may be referred to as the medium support member.

In some examples, first extension 140 and second extension 142 may have the same length. In some examples, first extension 140 and second extension 142 may have different lengths. Here, as shown in FIG. 5, first extension 140 is substantially longer than second extension 142. First extension 140 and second extension 142 provide lateral support to the hammock stand, as the remainder of the U-shaped platform is otherwise disposed on a single side of the hammock.

In some examples, lengths of the extensions may be selected to achieve an average distance from a centerline of the hammock to an imaginary line joining distal ends of the extensions. In some examples, lengths of the extensions may be selected to achieve a selected distance from a midpoint of the centerline to a midpoint of the imaginary line between the distal ends of the extensions. The average distance may be selected to provide adequate lateral support for the hammock as it swings while minimizing protrusion of the extensions into the room. In some examples, this average distance from the centerline may be 14 to 14.25 inches. However, other suitable distances may be utilized.

In some examples, the long support member 112 may be approximately 118 inches long (e.g., 117.9 inches), the medium support member 114 may be 41.5 inches long, the short support member 116 may be 5.5 inches long, the first extension 140 may be 22.5 inches long, and the second extension 142 may be 10.5 inches long. Other suitable lengths may be used. Lengths of the floor support members may be selected to obtain a specific angle $\alpha$ between the imaginary line between upper ends of the upright support members and an imaginary line parallel to the long support member (i.e., the angle of the hammock with respect to the wall). Angle $\alpha$ may have any suitable value, preferably less than or equal to approximately 45 degrees. For example, angle $\alpha$ may be less than 45 degrees, less than 30 degrees, less than 20 degrees, approximately 17 degrees, and/or any value greater than or equal to 15 degrees. Angles of 15 to 45 degrees may be preferable, such that the stand takes up a minimum of room space while still allowing a user in the hammock to swing from side to side.

Lengths of the floor support members may be selected to minimize an amount of floor space obstructed by the hammock and hammock stand. A smaller angle $\alpha$, which corresponds to a shorter medium support leg and/or a longer long support leg, results in a smaller footprint taken up by the stand, but also may limit the swing of the hammock. A larger angle $\alpha$, which corresponds to a longer medium support leg and/or a shorter long support leg, results in a larger footprint taken up by the stand.

Figure 6:
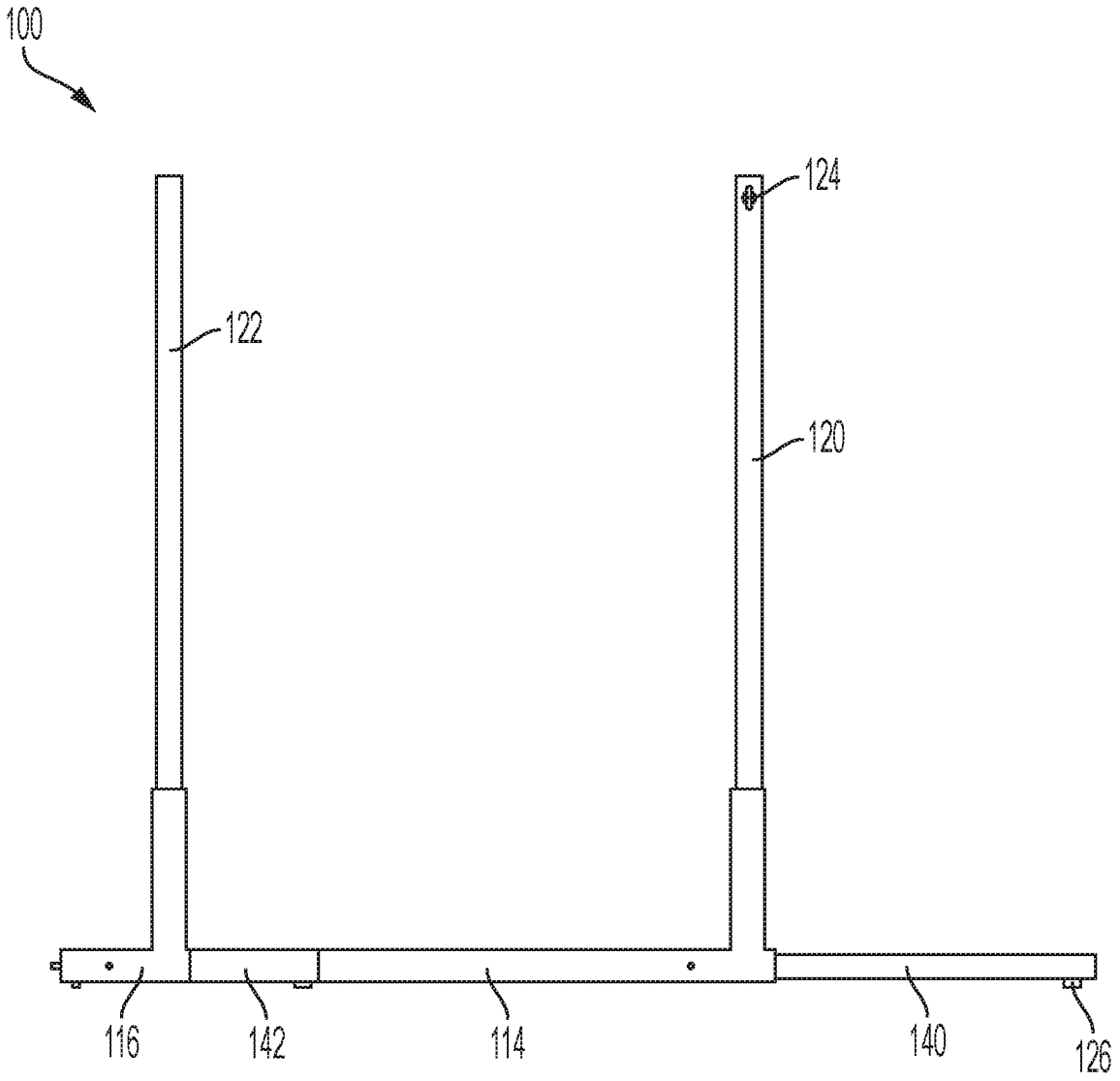
FIG. 6 is a side elevation view of the hammock stand of FIG. 1.

FIG. 6 depicts a side elevation view of corner hammock stand 100. In the example depicted, first upright support member 120 and second upright support member 122 have the same length or height. In some examples, the upright support members have different lengths. In some examples, the upright support members may be 48 inches in length. In some examples, the upright support members may be height-adjustable. The upright support members may be fixed (e.g., welded and/or bolted) to upper surfaces of the peripheral support members. In examples where the first and second horizontal legs and respective extensions are fixed to form unitary support members, the upright support members may be fixed to upper surfaces of the floor members at a position spaced from either end of the unitary support members (i.e., not at either end).

The various frame members of hammock stand 100 may comprise any suitable material configured to provide a rigid support structure capable of supporting the expected load of the hammock and its user. For example, each member may comprise a length of square or rectangular steel tubing, round bar, a metal I-beam, an angle iron, a wooden board, and/or the like. Members may be mated or coupled together either permanently or releasably, using any suitable method, e.g., joining, clipping, friction-fitting, welding, brazing, mechanical fastening (bolting, screwing, riveting, etc.), using an adhesive, or the like, and/or any combination of these. Connection points may include support brackets, bracing, connectors, clips, dovetail joints, etc.

Figure 7:
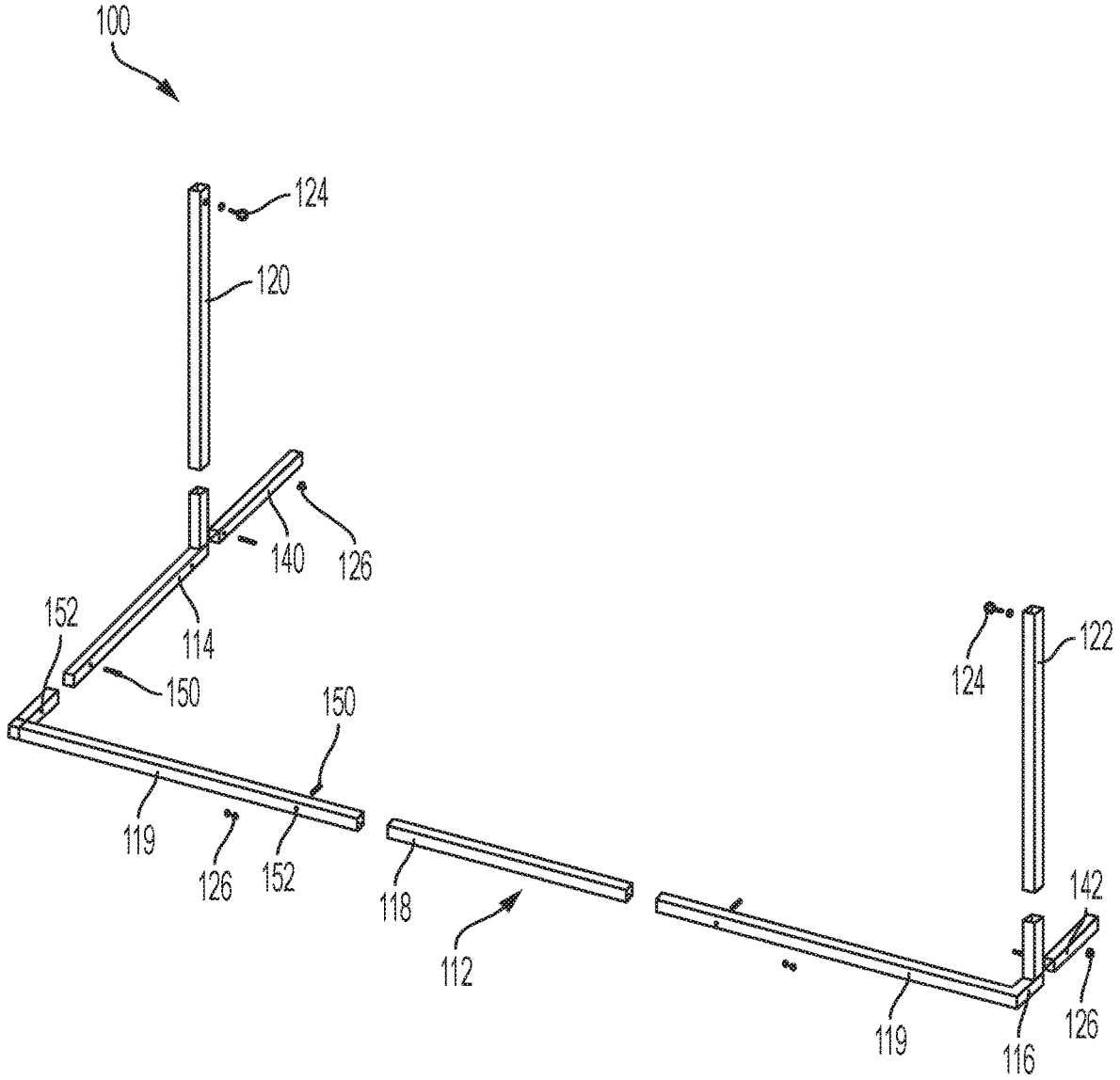
FIG. 7 is an exploded view of the hammock stand of FIG. 1.

In some examples, some or all of the frame members of hammock stand 100 are coupled together permanently, e.g., to form a monolithic structure. In some examples, as depicted in FIG. 7, hammock stand 100 includes various square tubes of differing dimensions configured to be assembled and disassembled as needed, e.g., by hand, without tools. Here, a first end portion 119 is configured to be coupled to a second end portion 119' using a coaxial connection member 118 having a smaller outer width and height. The two end portions slide onto opposing ends of the connection member and are each pinned to it, such that together the three components form the main horizontal frame member. In this example, both of the end portions have a 90-degree L-shaped end, such that a small length of tubing extends transversely from the end of the end portion. For example, second end portion 119 includes second horizontal leg 116, and first end portion 119 includes a part of first horizontal leg 114. A remaining part of the first horizontal leg slides or nests into the first end portion and is pinned in place to complete the leg.

Vertical stub tubes are fixed (e.g., welded) to the ends of the first and second horizontal legs, and configured to receive the upright hammock supports. First and second extensions 140 and 142 have a reduced outer height and width, such that each fits into the respective leg and is pinned in place. Feet 126 are installed on an underside of extensions 140 and 142 to account for the height difference and prevent wobbling of the frame.

Although various sections of the hammock stand are depicted in FIG. 7 and described above, more or fewer such sections may be utilized, as desired. The configuration of FIG. 7 has the advantage of being broken down and arranged into a compact stack. For example, the components of FIG. 7 may be arranged into a package having dimensions of five feet by eight inches by twelve inches (i.e., 5'×8"×12") for transport and/or shipping.

Hammock stand 100 is designed to function as a piece of furniture in a home. Only one support leg (i.e., second horizontal leg 116 and extension 140) intrudes into the room's living space, and extends only a short distance (e.g., 16 inches from the wall). This can easily be accommodated next to a bookcase, a chest of drawers, a couch, or even a potted plant. Removal of the hammock from the stand leaves only a nonintrusive frame, such that the entire room can be used with the stand remaining in place.

B. Illustrative A-Frame Collapsible Hammock Stand

Figure 8:
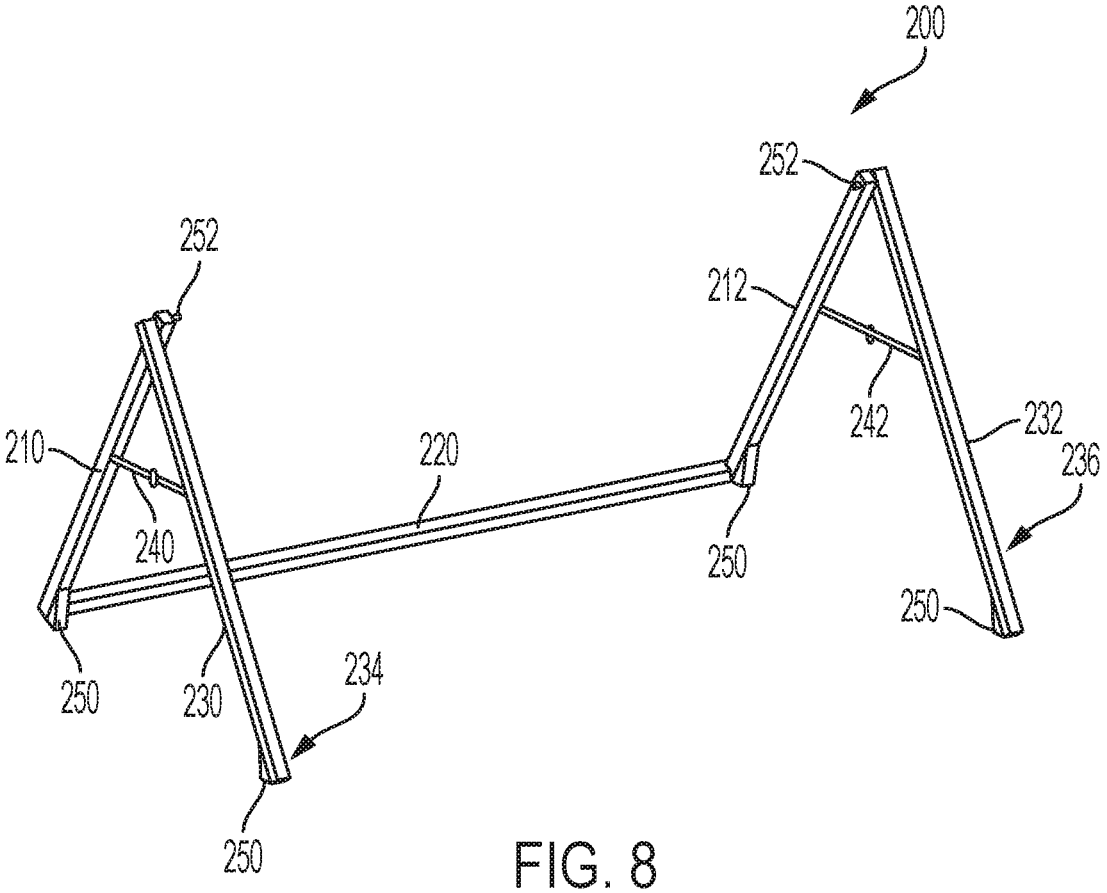
FIG. 8 is an isometric view of a second illustrative hammock stand in a first configuration.
Figure 9:
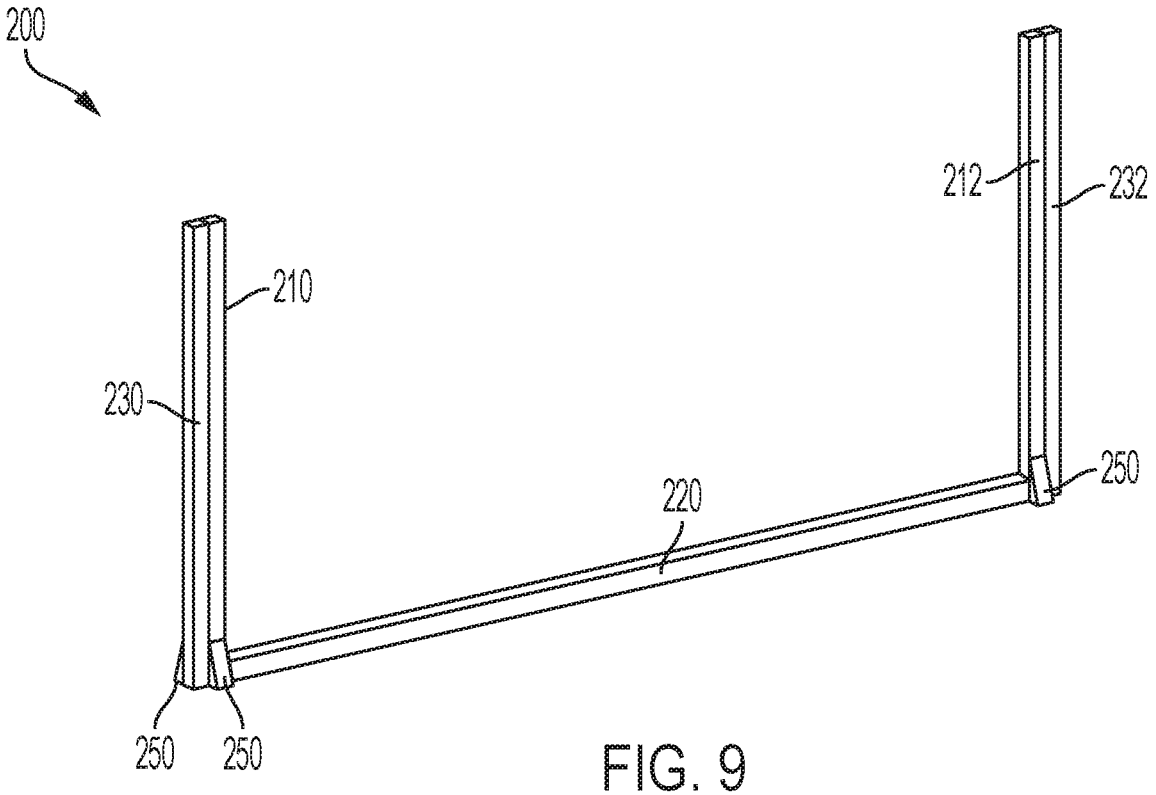
FIG. 9 is an isometric view of the hammock stand of FIG. 8 in a second configuration.

As shown in FIGS. 8 and 9, this section describes an illustrative collapsible hammock stand 200. Hammock stand 200 is an example of the hammock stands described in the Overview above.

Hammock stand 200 has an asymmetrical support structure that includes a collapsible A-frame support having a single horizontal support member running (e.g., along a wall) between two of the A-frame legs. A second pair of legs folds out from the first pair to complete the structure utilized to support the hammock in the operational configuration.

Space under the hammock remains usable. When the hammock is no longer in use, the second pair of legs can be folded inward to join the first pair of legs against the wall. The hammock can safely be stored upright out of the way, and the space can return to its normal function. The hammock does not need to be removed to be stored. This, for example, makes the hammock ideal for smaller multi-use spaces, hallways, balconies, sun rooms, offices, and/or in front of sliding glass doors which might only be used seasonally.

With reference to FIGS. 8 and 9, collapsible hammock stand 200 is now described in further detail. FIG. 8 illustrates hammock stand 200 in an operational configuration, and FIG. 9 illustrates hammock stand 200 in a stored or stowed configuration. Stand 200 includes a first pair of legs, namely leg 210 and leg 212, coupled to each other at lower ends by a floor support member 220, such that leg 210, floor support member 220, and leg 212 form a generally "U" shaped structure open at the top. The lower ends of the legs, where they are coupled to the floor support member, may be referred to as their proximal ends (with corresponding distal ends).

A second pair of legs, namely leg 230 and leg 232, are pivotably coupled to the distal ends of legs 210 and 212, respectively. Legs 230 and 232 are pivotably coupled to the other pair at first ends, while second ends 234, 236 of legs 230 and 232 remain free. Second ends 234 and 236 are pivotable toward and away from floor support member 220. Movement of the second pair of legs is constrained and limited by hinged braces 240 and 242 at each end of the structure, each of the hinged braces spanning a distance between the first pair and the second pair of legs. Accordingly, the first and second pairs of legs form two collapsible A-frame supports, where leg 210, leg 220, and brace 240 form one A-frame, and leg 212, leg 222, and brace 242 form another.

The second pair of legs are coupled to the outer sides of the first pair of legs (i.e., the first pair of legs are disposed between the second pair of legs), such that they sit adjacently outside the first pair of legs when collapsed. Ends of the legs that contact the support surface may include stabilizing feet 250, as depicted in FIGS. 8-9. As with hammock support 100, hooks or rings 252 (e.g., rings, hooks, clips, pins, pegs, or the like) are provided on distal ends of legs 210 and 212 and each configured to hold an end of hammock 130.

The various members of the frame of hammock stand 200 may comprise any suitable material configured to provide a rigid support structure capable of supporting the expected load of the hammock and its user. For example, each member may comprise a length of square or rectangular steel tubing, round bar, a metal I-beam, an angle iron, a wooden board, and/or the like. Members may be coupled together either permanently or releasably, using any suitable method, e.g., joining, clipping, pinning, friction-fitting, welding, brazing, mechanical fastening (bolting, screwing, riveting, etc.), using an adhesive, or the like, and/or any combination of these. Fixed connection points may include support brackets, bracing, connectors, clips, dovetail joints, etc. Pivotable connection points may include any suitable hinge mechanism or rotary joint configured to facilitate pivoting of the relevant members through an expected range of motion.

Legs 210, 212, 220, and 222 may have the same length or different lengths, depending on the desired effect. In general, corresponding legs that are pivotably coupled to each other will have the same length. In some examples, all four legs have the same length, such that the stand is substantially the same at each end. In some examples, one end of the stand may be shorter than the other.

C. Illustrative Vehicle Bumper-Mounted Collapsible Hammock Stand

Figure 10:
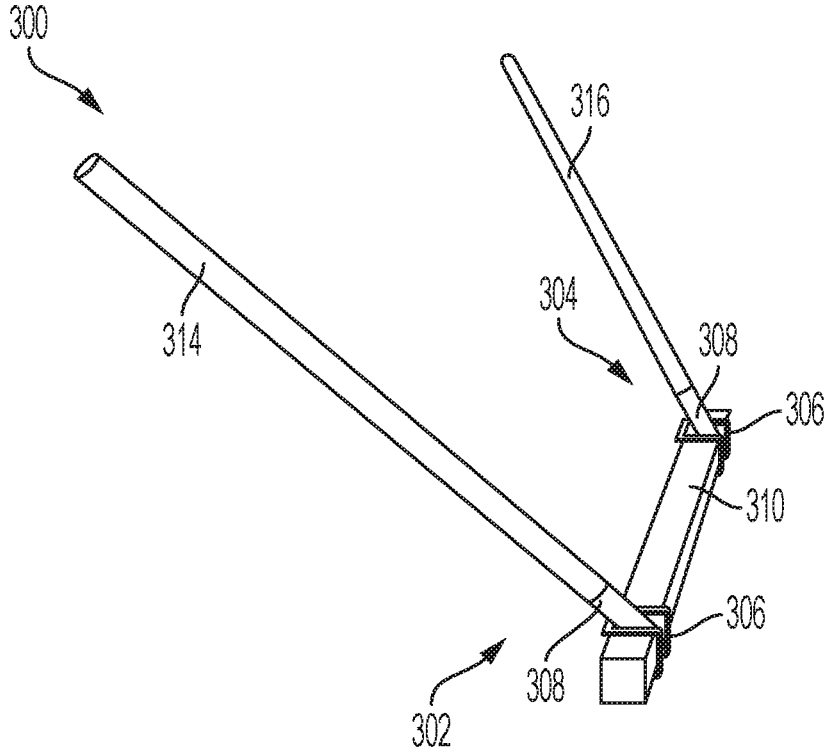
FIG. 10 is an isometric view of a third illustrative hammock stand.
Figure 11:
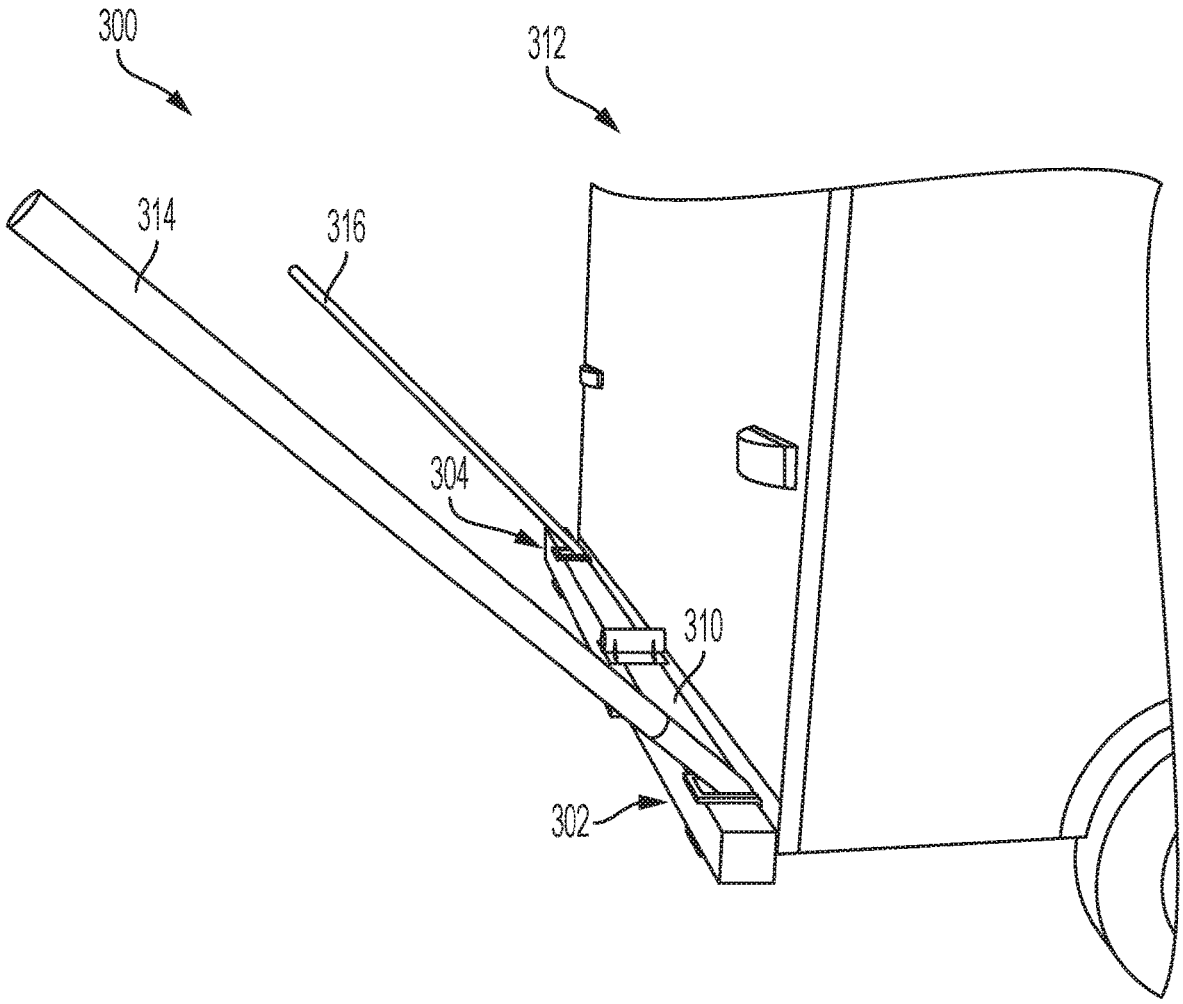
FIG. 11 is an isometric view of the hammock stand of FIG. 10 coupled to the bumper of a vehicle.
Figure 12:
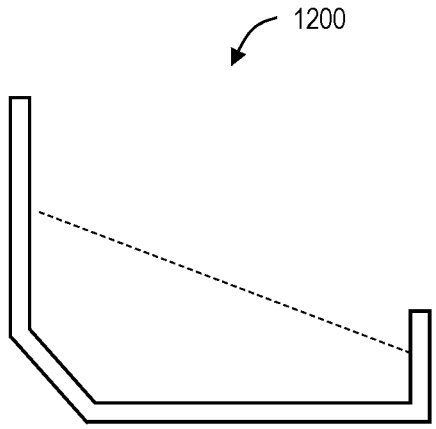
FIG. 12 is a schematic overhead view of an illustrative corner hammock stand according to the present disclosure.
Figure 13:
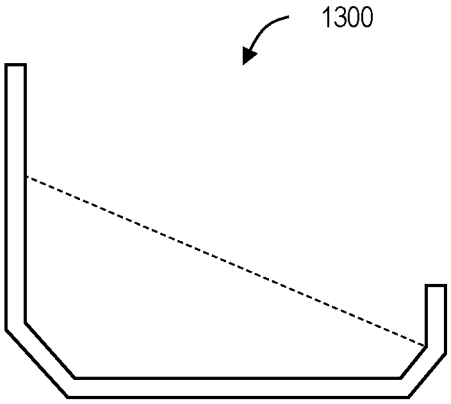
FIG. 13 is a schematic overhead view of another illustrative corner hammock stand according to the present disclosure.
Figure 14:
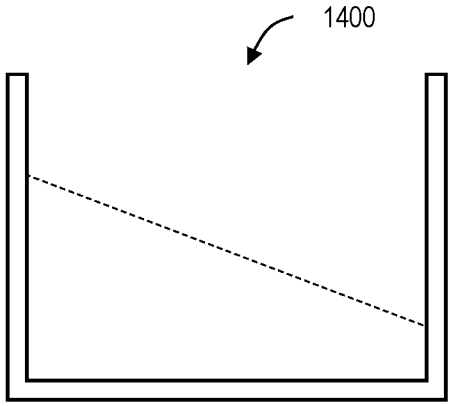
FIG. 14 is a schematic overhead view of another illustrative corner hammock stand according to the present disclosure.
Figure 15:
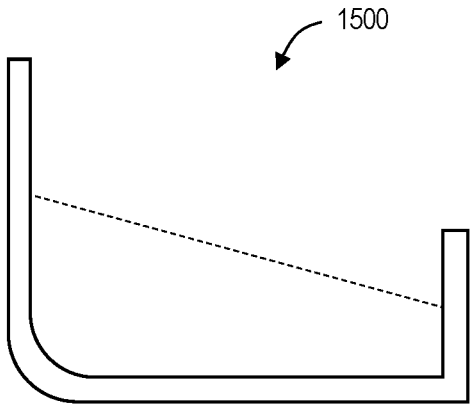
FIG. 15 is a schematic overhead view of another illustrative corner hammock stand according to the present disclosure.
Figure 16:
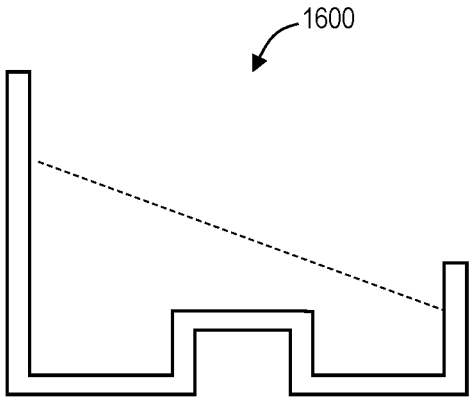
FIG. 16 is a schematic overhead view of another illustrative corner hammock stand according to the present disclosure.
Figure 17:
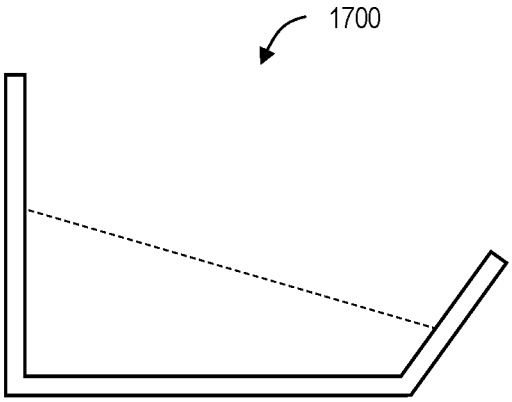
FIG. 17 is a schematic overhead view of another illustrative corner hammock stand according to the present disclosure.
Figure 18:
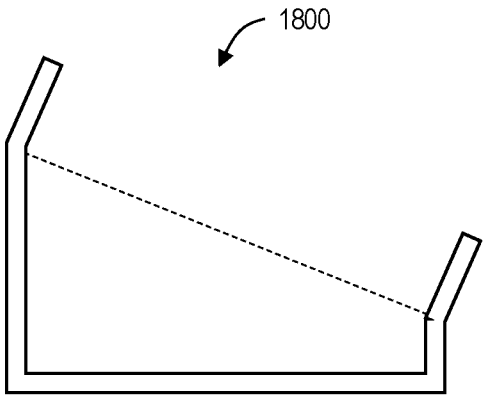
FIG. 18 is a schematic overhead view of another illustrative corner hammock stand according to the present disclosure.

As shown in FIGS. 10 and 11, this section describes an illustrative vehicle bumper-mounted collapsible hammock stand 300. Hammock stand 300 is an outdoor example of the hammock stands described in the Overview above.

In general, hammock stand 300 includes a pair of receivers removably coupled to either end of a vehicle bumper. The receivers each include a tubular receptacle, and the receptacles are oriented at an oblique angle relative to the bumper. Specifically, the receptacles are pointed upward and outward, such that they each extend away from each other, at an angle, in an outboard direction. Hammock supports having a substantially similar cross-sectional shape as the receivers may be inserted into the receivers, e.g., in a friction fit. Each support may include a length of rigid pipe, tube, beam, etc., that extends at the same angle as the receptacle. Accordingly, the distal ends of the hammock support members are splayed out at a separation distance suitable for hanging a hammock therefrom. The receivers may remain fixed to the bumper between uses, while the hammock support members may be removed and stored, so as not to interfere with vehicle operation. In some examples, the receivers include a hinged joint, such that the support members may be pivoted down against the bumper when not in use.

With reference to FIGS. 10 and 11, vehicle bumper-mounted collapsible hammock stand 300 is now described in further detail. Stand 300 includes a first pair of receivers, namely receiver 302 and receiver 304. Each of the receivers includes a base portion 306 and a receptacle portion 308. The base portion is configured to be mountable to a bumper 310 of a vehicle 312, e.g., by bolting or otherwise affixing it thereto. The receptacle portion includes a hollow tube configured to receive and support a hammock support member therein. Each of the receptacle portions protrudes from the base portion at an angle, such that when mounted the receptacles point upward and in an outboard direction, i.e., away from each other.

Each of the receptacle portions may protrude at any suitable acute angle measured from a line parallel to a centerline of the vehicle (e.g., less than 90 degrees, less than 75 degrees, less than 60 degrees, or less than 45 degrees). In some examples, each receptacle portion may protrude at the same angle. In some examples, each receptacle portion may protrude at different angles. In some examples, each receptacle protrudes 45 degrees from the bumper 310 and 45 degrees upward from a plane parallel to the ground. In some examples, the receivers include a hinged joint, so that the receptacle portion is transitionable between a variety of angled positions. In some examples, each receptacle may be disposed at a 22.5-degree angle from the centerline of the vehicle in a first position and disposed at a 45 degree angle from the centerline of the vehicle in a second position.

In some examples, vehicle-bumper mounted hammock stand 300 is configured to attach to a bumper of a camper or RV (e.g., a bumper comprising a square steel tube).

Stand 300 further includes a pair of hammock support members 314, 316, configured to be securely received in the receptacles. Each of the hammock support members may be a same or a different length, and may include a hammock-supporting hook, ring, and/or other supporting hardware at the distal end. In some examples, the hammock support members have a length suitable to allow multiple devices (e.g., spare tires, septic waste systems) to be coupled to the bumper. In some examples, the hammock support members are six feet long. In some examples, the cross section of each of the hammock support members is substantially identical. In some examples, the cross sections are different, corresponding to which receptacle the support member should be inserted into.

The various components of hammock stand 300 may comprise any suitable material configured to provide a rigid support structure capable of supporting the expected load of the hammock and its inhabitant. For example, each support member may comprise a length of square or rectangular steel tubing, round bar, a metal I-beam, an angle iron, a wooden board, and/or the like. Members may be coupled together either permanently or releasably, using any suitable method, e.g., joining, clipping, friction-fitting, welding, brazing, mechanical fastening (bolting, screwing, riveting, etc.), using an adhesive, or the like, and/or any combination of these. Fixed connection points may include support brackets, bracing, connectors, clips, dovetail joints, etc.

D. Illustrative Combinations and Additional Examples

This section describes additional aspects and features of space-saving hammock stands, presented without limitation as a series of paragraphs, some or all of which may be alphanumerically designated for clarity and efficiency. Each of these paragraphs can be combined with one or more other paragraphs, and/or with disclosure from elsewhere in this application, including the materials incorporated by reference in the Cross-References, in any suitable manner. Some of the paragraphs below expressly refer to and further limit other paragraphs, providing without limitation examples of some of the suitable combinations.

A0. A hammock stand, comprising:

a support frame including a main horizontal frame member, and a first leg and a second leg extending horizontally from a same side of the main horizontal frame member, such that the support frame is configured to conform to a corner of a room with the main horizontal frame member running along a first wall and the first leg running along a second wall;

a first hammock support post extending upward from the first leg;

a second hammock support post extending upward from the second leg;

wherein the first hammock support post is spaced a first distance from the main horizontal frame member along the first leg, the second hammock support post is spaced a second distance from the main horizontal frame member along the second leg, and the first distance is greater than the second distance.

A1. The hammock stand of A0, wherein the first distance is at least twice as long as the second distance.

A2. The hammock stand of A0, wherein an angle formed by a first imaginary line between the first and second hammock support posts and a second imaginary line parallel to the main horizontal frame member is less than or equal to 45 degrees.

A3. The hammock stand of A2, wherein the angle is greater than or equal to 15 degrees.

A4. The hammock stand of A2, wherein the angle is 17 degrees.

A5. The hammock stand of A0, wherein the second leg is shorter than the first leg.

A6. The hammock stand of A5, wherein the second leg is less than or equal to sixteen inches long, as measured from the first wall when installed in the room.

A7. The hammock stand of A5, wherein the first leg is less than or equal to sixty-four inches long, as measured from the first wall when installed in the room.

A8. The hammock stand of A0, wherein the first hammock stand post and the second hammock stand post extend upward at 90-degree angles from the support frame.

A9. The hammock stand of A0, wherein the first leg comprises a first removable extension.

A10. The hammock stand of A9, wherein the first removable extension extends from a remainder of the first leg on a side of the first hammock support post away from the main horizontal frame member.

A11. The hammock stand of A0, wherein the second leg comprises a second removable extension.

A12. The hammock stand of A11, wherein the second removable extension extends from a remainder of the first leg on a side of the second hammock support post away from the main horizontal frame member.

A13. The hammock stand of A0, wherein the main horizontal frame member comprises two square tubes nested onto opposing ends of a same smaller coaxial square tube and pinned thereto, such that the support frame is configured to be assembled and disassembled manually.

B0. A hammock stand, comprising:

a support frame having a horizontal base with horizontal first and second legs extending in a same direction from opposite ends of the base;

a first hammock support post extending upward from the first leg of the frame;

a second hammock support post extending upward from the second leg of the frame; and a hammock extending from the first hammock support post to the second hammock support post;

wherein the first and second hammock support posts are respectively positioned along the first and second legs such that a centerline of the hammock forms an acute angle with respect to the base of the frame when viewed from above.

B1. The hammock stand of B0, wherein the first and second legs have different lengths B2. The hammock stand of B1, wherein the first leg is longer than the second leg, and the hammock stand is configured to conform to a corner of a room with the base and first leg along respective walls and the second leg protruding into the room.

B3. The hammock stand of B2, wherein the first leg is at least twice as long as the second leg.

B4. The hammock stand of B0, wherein the acute angle is less than or equal to 45 degrees.

B5. The hammock stand of B4, wherein the acute angle is greater than or equal to 15 degrees.

B6. The hammock stand of B5, wherein the acute angle is 17 degrees.

B7. The hammock stand of B0, wherein the support frame comprises a plurality of segments configured to be assembled and disassembled by hand.

B8. The hammock stand of B2, wherein the second leg is less than or equal to sixteen inches long, as measured from the first wall when installed in the room.

B9. The hammock stand of B8, wherein the first leg is less than or equal to sixty-four inches long, as measured from the first wall when installed in the room.

B10. The hammock stand of B0, wherein the base is approximately 118 inches long.

B11. The hammock stand of B0, wherein the first hammock stand post and the second hammock stand post extend upward at 90-degree angles from the support frame.

C0. An asymmetrical freestanding support structure configured to hold a hammock, wherein the support structure comprises:

a floor support platform including a first horizontal floor support member and a second horizontal floor support member coupled together at respective first ends to form a 90-degree angle, such that the support structure is configured to conform to the corner of a room; and a third horizontal floor support member extending at a 90-degree angle from a second end of the second horizontal floor support member;

wherein the hammock is supported across the corner at an angle by upright members, one of which extends upward from the first horizontal floor support member and the other of which extends upward from the third horizontal floor support member.

C1. The structure of C0, wherein the third horizontal floor support member is less than half the length of the first horizontal floor support member.

C2. The structure of C0, wherein the upright supports are spaced from respective distal ends of the floor support members, such that the first and third floor support members extend beyond the upright supports in a direction away from the second floor support.

D0. An A-frame support structure comprising:

a first pair of legs and a second pair of legs, the first pair of legs being pivotably coupled to the second pair of legs, such that the structure is configured to hold a hammock such that one pair is on one lateral side of the hammock when in use, and the other pair is on an opposite side of the hammock; and a horizontal support at floor level, running between one pair of legs.

D1. The structure of D0, wherein the support structure is collapsible from an operational configuration into a storage configuration, by pivoting one pair of legs against the other pair.

D2. The structure of D0, wherein the structure has only one horizontal support.

E0. A hammock support structure comprising:

a pair of stub receivers attachable to a vehicle bumper at either end of the bumper; and a pair of corresponding hammock support members insertable into the stub receivers;

wherein the support members are rigid and have a length that places their distal ends at suitable positions for hanging a hammock therefrom.

E1. The structure of E0, wherein the support structure is collapsible from an operational configuration into a storage configuration, by removing the support members from the receivers and storing the support members.

E2. The structure of E0, wherein the support structure is collapsible from an operational configuration into a storage configuration, by rotating the receptacles at respective hinged joints to pivot the support members against the bumper.

F0. Floor support frames for corner hammock stands of the present disclosure (e.g., stand 100) may have a variety of shapes, arrangements, and/or configurations. A variety of illustrative corner hammock stands functionally similar to stand 100 are described below and illustrated schematically in the overhead views of FIGS. 12-18. These examples may be considered variations of hammock stand 100. Aspects of the frames described below may be used interchangeably in any of the corner hammock stands described herein (e.g., corner hammock stand 1300 may include the second horizontal leg of corner hammock stand 1700). Although not illustrated explicitly in FIGS. 12-18, hammock support posts may be coupled to the first and second horizontal legs at any suitable location, as described with respect to stand 100.

F1. An illustrative corner hammock stand 1200 (see FIG. 12) includes a main horizontal frame member, a first horizontal leg, and a second horizontal leg, substantially as described with respect to stand 100. In this example, an angled frame member effectively cuts the corner that would otherwise be formed if the first horizontal leg were connected directly to the main horizontal frame member. This configuration may be utilized, for example, to avoid a fixed object (e.g., a vertical pipe) in the corner of the room. The first horizontal leg is oriented at a 90-degree angle with respect to the main horizontal frame member, and the two are coupled together by the angled frame member. Throughout FIGS. 12-18, a dashed line is utilized to indicate generally where the hammock would be hung on the frame.

F2. Another illustrative corner hammock stand 1300 (see FIG. 13) is substantially similar to the hammock stand of FIG. 12, but with a second angled frame member coupling the main horizontal frame member and the second leg.

F3. Another illustrative corner hammock stand 1400 (see FIG. 14) includes a main horizontal frame member and first and second horizontal legs that are substantially equal in length. This design may be utilized to increase stability and/or may be used in a smaller room (or bigger hammock stand) where the three horizontal frame members run along three respective walls of the room.

F4. Another illustrative corner hammock stand 1500 (see FIG. 15) includes a main horizontal frame member coupled to the first horizontal leg at a curved corner. This design may be utilized, e.g., to conform to a curved corner of a room.

F5. Another illustrative corner hammock stand 1600 (see FIG. 16) includes a main horizontal frame member having a jog formed by a parallel portion of the main horizontal frame member being offset from the rest. In other words, the main horizontal frame member includes a segmented section which protrudes into the overall U-shape of the frame. This cutout may facilitate avoidance of a radiator, vent, outlet, and/or any architectural feature which may otherwise prevent use of the wall.

F6. Another illustrative corner hammock stand 1700 (see FIG. 17) includes a second horizontal leg that is coupled to the main horizontal member at an obtuse angle. This design may increase lateral stability and/or facilitate hiding or otherwise placing the second leg in a different position with respect to the room.

F7. A corner hammock stand 1800 (see FIG. 18) includes first and second extensions that are not in line with the first and second legs. In this example, the extensions protrude orthogonally with respect to the centerline of the hammock, thereby increasing stability when the hammock rocks, as compared with similar-length, inline extensions.

Advantages, Features, and Benefits

The different embodiments and examples of the hammock stands described herein provide several advantages over known solutions for supporting hammocks.

For example, illustrative embodiments and examples described herein allow hammocks to be hung indoors without substantially sacrificing usable space for other furniture and household objects.

Additionally, and among other benefits, illustrative embodiments and examples described herein allow the hammock stand to be easily collapsed when not in use.

Additionally, and among other benefits, illustrative embodiments and examples described herein allow a user to enjoy the benefits of a hammock while at a campground, a tailgating event, or the like, without needing to damage trees or leave the vicinity of the user's vehicle.

Additionally, and among other benefits, illustrative embodiments and examples described herein provide an aesthetically interesting support frame.

No known system or device can perform these functions. However, not all embodiments and examples described herein provide the same advantages or the same degree of advantage.

Conclusion

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

What is claimed is:

1. A hammock stand, comprising:

a support frame having a horizontal base with horizontal first and second legs extending in a same direction from opposite ends of the base, such that the support frame is U-shaped;

a first hammock support post extending upward from the first leg of the support frame;

a second hammock support post extending upward from the second leg of the support frame; and a hammock extending from the first hammock support post to the second hammock support post, such that the horizontal base is disposed entirely on one lateral side of a centerline of the hammock;

wherein the first and second hammock support posts are respectively positioned along the first and second legs such that the centerline of the hammock forms an acute angle with respect to the base of the frame when viewed from above.

2. The hammock stand of claim 1, wherein the first leg is longer than the second leg, and the hammock stand is configured to conform to a corner of a room with the base and first leg respectively along a first wall and a second wall and the second leg protruding into the room.

3. The hammock stand of claim 2, wherein the second leg is less than or equal to sixteen inches long, as measured from the first wall when installed in the room.

4. The hammock stand of claim 2, wherein the first leg is less than or equal to sixty-four inches long, as measured from the first wall when installed in the room.

5. The hammock stand of claim 1, wherein the first leg is at least twice as long as the second leg.

6. The hammock stand of claim 1, wherein the acute angle is less than or equal to 45 degrees.

7. The hammock stand of claim 6, wherein the acute angle is greater than or equal to 15 degrees.

8. The hammock stand of claim 1, wherein the support frame comprises a plurality of segments configured to be assembled and disassembled by hand.

9. The hammock stand of claim 1, wherein the first hammock stand post and the second hammock stand post extend upward at 90-degree angles from the support frame.

10. A hammock stand, comprising:

a support frame including a main horizontal frame member, and a first leg and a second leg extending horizontally from a same side of the main horizontal frame member, such that the support frame is configured to conform to a corner of a room with the main horizontal frame member running along a first wall and the first leg running along a second wall, wherein the support frame defines a plane;

a first hammock support post extending upward from the first leg;

a second hammock support post extending upward from the second leg;

wherein the first hammock support post is spaced a first distance from the main horizontal frame member along the first leg, the second hammock support post is spaced a second distance from the main horizontal frame member along the second leg, and the first distance is greater than the second distance, such that an acute angle is formed by an intersection of (a) a first imaginary line extending through an upper end of the first hammock support post and an upper end of the second hammock support post and (b) a second imaginary line extending through the upper end of the second hammock support post and parallel to the main horizontal frame member when projected onto the plane of the support frame.

11. The hammock stand of claim 10, wherein the first distance is at least twice as long as the second distance.

12. The hammock stand of claim 10, wherein an angle formed by a first imaginary line between the first and second hammock support posts and a second imaginary line parallel to the main horizontal frame member is less than or equal to 45 degrees.

13. The hammock stand of claim 12, wherein the angle is greater than or equal to 15 degrees.

14. The hammock stand of claim 10, wherein the first leg is at least twice as long as the second leg.

15. The hammock stand of claim 10, wherein the first hammock support post and the second hammock support post extend upward at 90-degree angles from the support frame.

16. The hammock stand of claim 10, wherein the first leg comprises a first removable extension.

17. The hammock stand of claim 16, wherein the first removable extension extends from a remainder of the first leg on a side of the first hammock support post away from the main horizontal frame member.

18. An asymmetrical freestanding support structure configured to hold a hammock, wherein the support structure comprises:

a floor support platform including a main horizontal floor support member and a first horizontal floor support member coupled together at respective first ends to form a 90-degree angle, such that the support structure is configured to conform to a corner of a room, wherein the floor support platform defines a plane; and a second horizontal floor support member extending at a 90-degree angle from a second end of the main horizontal floor support member;

wherein the hammock is supported across the corner at an angle by upright supports, one of which extends upward from the first horizontal floor support member and the other of which extends upward from the second horizontal floor support member; and wherein an acute angle is formed by an intersection of (a) a first imaginary line extending through upper ends of the upright supports and (b) a second imaginary line extending parallel to the main horizontal floor support member when projected onto the plane of the floor support platform.

19. The support structure of claim 18, wherein the second horizontal floor support member is less than half as long as the first horizontal floor support member.

20. The support structure of claim 18, wherein the upright supports are spaced from respective distal ends of the first and second floor support members, such that the first and second floor support members extend beyond the upright supports in a direction away from the main horizontal floor support member.

* * * * *